United States Patent [19]

Bunner

[11] 3,970,972

[45] July 20, 1976

[54] SHOCK RESISTANT, TEMPERATURE COMPENSATED HELICAL RESONATOR

[75] Inventor: Charles Brian David Bunner, Carp, Canada

[73] Assignee: Northern Electric Company Limited, Montreal, Canada

[22] Filed: May 12, 1975

[21] Appl. No.: 576,277

[52] U.S. Cl. ..... 333/82 BT; 333/83 T

[51] Int. Cl.[2] ..... H01P 1/30; H01P 7/04

[58] Field of Search ..... 333/82 R, 82 B, 82 BT, 333/83 T; 331/69, 70; 336/178, 179, 84 C

[56] References Cited

UNITED STATES PATENTS 2,317,724 4/1943 Bergtold ..... 336/179 X 2,584,592 2/1952 Kehbel ..... 336/179 X

*Primary Examiner*—Paul L. Gensler

*Attorney, Agent, or Firm*—Achmed N. Sadik

[57] ABSTRACT

A temperature compensated helical resonator structure having a rigid dielectric filling between helix and shield of a material with a negative thermal coefficient of permittivity. The filling provides shock resistance by preventing the helix from vibrating, while simultaneously aiding in thermal compensation.

12 Claims, 2 Drawing Figures

SHOCK RESISTANT, TEMPERATURE COMPENSATED HELICAL RESONATOR

FIELD OF THE INVENTION

The present invention relates to helical resonators in general and to temperature compensated resonators in particular.

BACKGROUND AND SUMMARY OF THE INVENTION

Temperature compensation in many types of resonators is often accomplished by utilizing metals with different thermal coefficients of expansion. The desired effect is that as one structural part expands or contracts with temperature the other parts do the same to a larger or lesser degree such that the resonant frequency of the resonator remains within certain specified limits.

While the prior art shows many examples of temperature compensated cavity resonators, this cannot be said of helical resonators. A helical resonator consists of a helical coil (helix) wound on a dielectric form spaced from and surrounded by an electrical shield. It is simply a parallel tuned circuit in which the lumped inductor, the helix, resonates with the distributed capacitance from the helix to the shield. By choosing the helix and shield materials to have different thermal coefficients of expansion, the increase in inductance of the helix with temperature could be compensated for by the decrease in distributed capacitance from the helix to the shield, as the latter also expands. The ratio of the two thermal coefficients of expansion necessary would depend primarily on the geometry of the resonator (helix and shield).

The present invention provides a temperature compensated helical resonator structure, that also exhibits drop or shock resistance. Shock resistance is achieved by providing in the otherwise vacant space between helix and shield a rigid dielectric filling. However, the simple introduction of a filling dielectric would interfere with the temperature compensation that has been achieved, due to the dielectric material's own behaviour with temperature. As will be shown in conjunction with the detailed description later on, it is at best impractical to try to find a combination of two metals plus a third material that would satisfy the conditions for thermal stability. It was found, however, that by providing the dielectric filling in such amount to yield a desired average (i.e. effective) permittivity of the space between helix and shield, temperature compensation is enhanced in addition to the achievement of additional support for the helix against shock. The filling dielectric in most cases must have a negative thermal coefficient of permittivity, the value of which determines the amount of filling (i.e. fill factor).

As a result of this improvement it is now possible to have temperature compensated, shock resistant, helical resonators made from a single metal, for example copper which is a good conductor in addition to being inexpensive and practical to work and machine. It is often more practical, however, to use a material such as brass (or aluminum) for the housing and conventional copper wire for the helix, since brass is even easier to work and machine than is copper.

Thus, according to the present invention there is provided a helical resonator structure comprising a housing having inside walls and an end portion, and being of a conductive material having a first positive thermal coefficient of expansion; a form of dielectric material inside said housing spaced from the inside walls and supported by said end portion, said form supporting a thereon wound conductive helix of a material having a second positive thermal coefficient of expansion; and rigid dielectric filling disposed in selected locations contiguous said helix and the inside walls in the space therebetween, said dielectric filling being of a predetermined amount to produce an average permittivity of the total of said space, that is larger than that of air but less than that of dielectric filling material, and said dielectric filling material having a negative thermal coefficient of permittivity.

BRIEF DESCRIPTION OF THE DRAWINGS

An example embodiment of the present invention will now be described in conjunction with the attached drawings in which.

DESCRIPTION OF THE EXAMPLE EMBODIMENT

Figure 1:
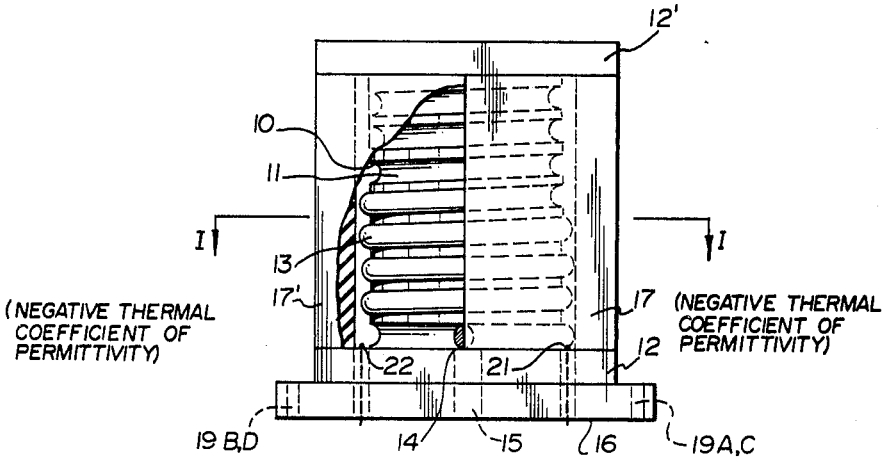
FIG. 1 is a helical resonator structure according to the present invention shown with its housing walls removed and a portion of the dielectric filling cut away.
Figure 2:
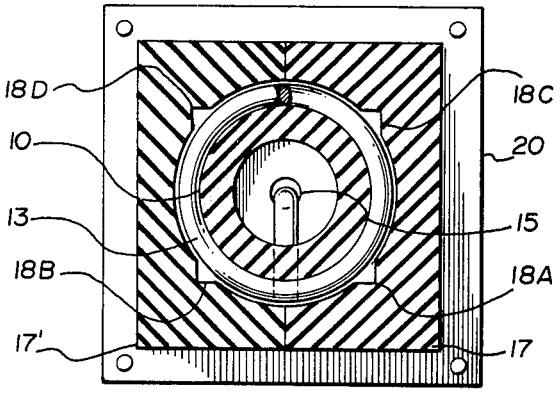
FIG. 2 is a cross-section along the lines I—I in FIG. 1 of the fully assembled helical resonator.

Referring now to FIG. 1 of the drawings, the helical resonator comprises a hollow coil form 10 of alumina having a helical groove 11 in its outer surface and two integral square end portions 12 and 12', a copper helix 13 wound on the coil form 10 in the helical groove 11, one end of the helix 13 is free and unconnected, and the other end, that is the one close to the removable end portion 12, is extended and passes through a hole 14 through the coil form 10 exiting into the form 10 hollow and extending axially into a hole 15 in a brass housing end portion 16 wherein the end is soldered; the wall portion of the brass housing, which is removed in FIG. 1 for clarity, is shown in cross-section in FIG. 2 and numbered 20. Surrounding the helix 13 and extending between the end portions 12 and 12' is a dielectric shroud of Rexolite which is comprised of two identical and oppositely fitting portions 17 and 17' (shown in cross-section in FIG. 2); the inside surface of the shroud portions 17 and 17' is mostly cylindrical and, when properly assembled, is contiguous with the helix 13. Rectangular corners 18A, B, C and D (shown more clearly in FIG. 2) interrupt the cylindrical inside surface of the shroud portions 17 and 17' and are provided to control the amount of Rexolite dielectric inside the resonator cavity. Four holes 19A, B, C and D, close to the corners of the end portion 16, permit securing the whole assembly to the removed part of the housing.

A cross-section along the line I—I in FIG. 1 is shown in FIG. 2, with like numbers referencing the same parts. As may be ascertained from that Figure, the corners 18A, B, C and D are a convenient means of adjusting the "fill factor" of the space between the helix 13 and the inside walls of the housing 20 with the Rexolite dielectric.

Design formulas for such basic configurations of helical resonators are well known. The equations for a quarter-wave resonator as that of the example embodiment are:

$$L = 0.174n^2d^2[1.44 - (\frac{d}{s})^2]\mu H/\text{axial inch},$$

-continued and $$C = 0.75 \frac{\epsilon_r}{\log_{10} 1.2(\frac{s}{d})} pF/\text{axial inch};$$

where $n$ is the number of turns/inch, $d$ is the helix 13 mean diameter, $s$ is the inside length of one side of the (shield) housing 20, and $\epsilon_r$ is the relative permittivity of the medium between the helix and the shield or housing. These equations are approximations derived from those for a cylindrical shield by setting $1.2s$ for the shield inside diameter. The resonant frequency, of course, is:

$$f_o = \frac{1}{2\pi \quad LC}.$$

It is fairly straightforward to obtain a condition for thermal stability of the resonant frequency $f_o$ by differentiating the above formulas with respect to temperature. The condition simply is:

$$\frac{L'}{L} = -\frac{C'}{C},$$

where $L'$ and $C'$ are the derivatives of $C$ and $L$, respectively, with respect to temperature. Explicitly, by substituting the actual equations of $L$, $L'$,$C$ and $C'$, the condition is $$\frac{s'}{d'} = (\frac{s}{d}) - \frac{2(\frac{s}{d})\log_{10}1.2(\frac{s}{d})[1.44(\frac{s}{d})^2-1]}{2\log_{10}1.2(\frac{s}{d})-1.44(\frac{s}{d})^2+1}$$

where $d'$ and $s'$ are the derivations of $d$ and $s$ with respect to temperature, or the thermal coefficients of expansion of the respective material of helix 13 and housing 20.

In trying to realize the above condition for temperature stability one is constrained by the obvious and necessary requirement that $(s/d)$ be larger than unity. In addition, a maximum size is usually a practical limitation. This is an important limitation at frequencies where helical resonators have highest utility, i.e. around 200–300MHz. Practical $(s/d)$ ratios are, therefore, in the vicinity of 1.5. Substituting 1.5 for $(s/d)$ in the above condition yields a ratio of thermal coefficient of expansion $s'/d'$ that is close to those of metal combinations such as:

Aluminum — Tungsten ( $\frac{s'}{d'} = 6.24$),

Brass — Tungsten ( $\frac{s'}{d'} = 4.4$),

Kovar — Invar ( $\frac{s'}{d'} = 6.2$), and

Tungsten — Invar ( $\frac{s'}{d'} = 4.6$).

Several practical considerations make metals such as Invar and Tungsten undesirable for use in a mass-production item (cost, machinability, gold or silver inside plating necessary, etc.). In addition, the requirement of shock resistance in the helical resonator of the present invention, makes it necessary to have a rigid dielectric in the cavity to prevent the free end of the helix 13 from being displaced outwardly. However, should one attempt to introduce the relative permittivity as yet another factor in determining a condition for temperature stability, the resultant combination of three different materials would be practically difficult, if not in some cases impossible, to find.

It was therefore found that a practical solution is provided by utilizing commonly available metals such as copper for the helix 13 and brass for the housing 20, and compensating the frequency drift with temperature by means of a dielectric filling having a negative thermal coefficient of permittivity. In order to be able to obtain the proper effective thermal coefficient of permittivity, a dielectric fill factor for the space between helix and housing of less than unity was considered and this method was found practical and satisfactory. In the example embodiment Rexolite was chosen for its temperature coefficient of permittivity of -80 parts per million (PPM)/degree Kelvin, and for the ease with which it can be machined. This relatively high temperature coefficient permits more latitude in temperature compensation.

It would be too cumbersome to attempt to calculate the amount of dielectric filling, and a practical approach yields the best results. However, once the amount of dielectric material has been determined for a particular design it has been found not to require adjustment from unit to unit, although fine tuning may be necessary to to compensate for manufacturing inconsistencies. Such fine tuning may be provided by means of a brass screw through the housing end opposite the end portion 16 that protrudes into the inside of the form 10, which screw would alter the total helix-housing capacitance sufficiently for fine tuning.

Coupling of signals in and out of the resonator may be accomplished in any of a number of ways known in the art, for example, by providing two single loops 21 and 22 in FIG. 1 close to the end of the end portion 16 adjacent the helix 13. One loop constitutes the input port and the other the output port. Such light coupling has the advantage of not loading the resonator to any appreciable degree as to affect its Q.

While the present example embodiment utilized brass and copper it is possible to use copper or aluminum instead of brass, or any good conducting, machinable metal. It has in fact been found that an all copper resonator differs little from the resonator of the example embodiment. However, as mentioned supra, brass is a more suitable material for the housing 20, while the helix 13 is readily made from the abundantly available copper wire types. Aluminum is not as suitable as brass, if the resonator unit is to be nickel - or gold plated as a measure against corrosion.

Other dielectric materials may be used for the form 10, such as beryllia. While the permittivity of the form 10 is not paramount in determining temperature stability, it should preferably be low.

What is claimed is:

1. A helical resonator structure, comprising:

a. a housing having inside walls and an end portion, and being of a conductive material having a first positive thermal coefficient of expansion;

b. a form of dielectric material inside said housing spaced from the inside walls and supported by said end portion, said form supporting a thereon wound helical conductor of a material having a second positive thermal coefficient of expansion; and c. rigid dielectric filling disposed in selected locations contiguous said helical conductor and the inside walls in the space therebetween, said dielectric filling being of a predetermined amount to produce an average permittivity of the total of said space that is larger than that of air but less than that of the dielectric filling material, and said dielectric filling material having a negative thermal coefficient of permittivity.

2. The helical resonator structure of claim 1, said first and second positive thermal coefficients of expansion being substantially equal.

3. The helical resonator structure of claim 2, said housing and said helical conductor being of a single good conducting machinable metal.

4. The helical resonator structure of claim 2, further comprising input and output means for coupling signals in and out of the helical resonator.

5. The helical resonator structure of claim 1, said conductive housing being of brass, said helical conductor being of copper, and said dielectric filling being of Rexolite.

6. The helical resonator structure of claim 5, said form being of alumina.

7. The helical resonator structure of claim 6, further comprising input and output means for coupling signals in and out of the helical resonator.

8. The helical resonator structure of claim 6, said housing having rectangular cross-section, said form being cylindrical with a helical groove in its outer surface, said helical groove having said helical conductor therein, and said helical conductor having one end in electrical contact with said housing and the other end free from electrical connection.

9. A helical resonator structure, comprising a conductive housing of rectangular cross-section having inside walls and a removable end portion, a cylindrical form of alumina secured to said end portion and having a helical groove in its outer surface adapted to accept a therein located conductive helix one end of which is in electrical contact with said end portion and the other end of which is free and unconnected, and Rexolite dielectric filling disposed contiguous the free end of said helix and other selected locations in the space between said helix and said inside walls, said Rexolite dielectric filling being of a predetermined amount effecting an average permittivity of the total of said space that is larger than that of air but less than that of Rexolite.

10. The helical resonator structure of claim 9, said conductive housing being of brass.

11. The helical resonator structure of claim 9, said conductive housing being of copper.

12. The helical resonator structure of claim 9, said conductive housing being of aluminum.

* * * * *